United States Patent [19]

Pryke

[11] 3,992,890

[45] Nov. 23, 1976

[54] METHOD OF FORMING FOUNDATIONS

[75] Inventor: David S. Pryke, Brent Pelham, England

[73] Assignee: Pynford Limited, England

[22] Filed: Oct. 2, 1975

[21] Appl. No.: 619,237

Related U.S. Application Data

[63] Continuation of Ser. No. 436,923, Jan. 28, 1974.

[52] U.S. Cl. ..... 61/50; 61/51; 61/53; 61/53.52; 61/56

[51] Int. Cl.[2] ..... E02D 5/24; E02D 7/20

[58] Field of Search ..... 61/50, 52, 51, 53.5, 61/53, 53.52, 56; 52/309

[56] References Cited

UNITED STATES PATENTS

| | | | |
|---|---|---|---|
| 2,850,890 | 9/1958 | Rubenstein | 52/309 |
| 3,685,303 | 8/1972 | Turzillo | 61/50 X |
| 3,763,654 | 10/1973 | Matsushita | 61/53.5 |

FOREIGN PATENTS OR APPLICATIONS

| | | | |
|---|---|---|---|
| 1,028,862 | 3/1953 | France | 61/50 |
| 783,799 | 10/1957 | United Kingdom | 61/51 |

*Primary Examiner*—Jacob Shapiro

[57] ABSTRACT

The invention is concerned with a method of constructing or stabilizing an open site foundation wherein a series of slender piles each having a width of no more than 100mm. are driven into the ground and the tops of the piles are united with a thin concrete slab.

12 Claims, 2 Drawing Figures

METHOD OF FORMING FOUNDATIONS

This is a continuation of application Ser. No. 436,923, filed Jan. 28, 1974.

The usual type of foundation used for houses and factory buildings consists of solid footings which are created by digging trenches a meter or more in the ground where the load bearing walls of the building are to stand, and filling the trenches with concrete. The digging of the trenches involves a considerable amount of work and the volume of concrete required to fill the trenches is considerable. One difficulty is that in the event of there being a bed of unstable disturbed ground, for example dried out clay, within 3 m. of the surface, the trenches have to be dug deep into the ground until stable earth is reached, with a commensurate increase in time and cost, or else piles have to be put down at intervals along the foundation. Similar problems are believed to exist in areas subject to permafrost. One existing technique of putting down such piles involves using an auger to drill holes, which may be 375 mm. or more in diameter, at intervals in the ground and subsequently forming piles in the holes. This is not entirely satisfactory because auger machines are normally hired by the site contractor and in order to reduce the hire time charge to a minimum, the holes are bored far more quickly than the piles can be formed and before the last piles are formed it frequently happens that their holes have been partly refilled with dirt necessitating cleaning out and remaking the base of the hole. Structurally, the piles of say 375 mm. diameter are capable of supporting a load of up to 20 tons and this is such a high proportion of the load to be carried that, in order to avoid the use of an unnecessarily large number of the expensive piles, the piles are spaced at long intervals along the foundations. It is then necessary to unite the tops of the piles with a beam of concrete in order to carry the load in the long span between the piles. Irrespective of whether solid footings or piles are taken down to the depth of stable earth, experiments have to be conducted prior to or during the construction of the foundations to determine when stable earth has been reached. In brief the conventional methods are all cumbersome and involve the handling of a large mass of material at a time when modern constructional design for the above ground part of the building is tending towards lighter materials.

The present invention overcomes the problems of these previous cumbersome methods of open site foundation construction by adopting an entirely new approach, according to which the foundation is constructed by driving into the ground at comparatively closely spaced intervals a series of slender piles each having a width of no more than 100 mm., and uniting the tops of the piles with a thin concrete slab.

Slender piles of up to 100 mm. in width, and preferably between 25 and 65 mm. in width, can be quickly driven into the ground down to a depth of 6 or 7 m., using comparatively simple equipment. The piles, which may be of any cross sectional shape, are driven in until the foot of the pile forces its way say 3 or 4 m into stable soil, as indicated by a given reaction force being reached. Relying primarily on skin friction between the lower 4 meter of its length and the surrounding stable earth, we estimate that a circular pile having a diameter of 50 mm can support a load of 4½ tons that is a safe load of 1½ tons, and piles of different diameter, a load pro rata with their diameter. An equivalent force of 4½ tons to drive in such a pile is then readily available from conventional portable jacking systems with or without additional vibration equipment to reduce the friction between the pile and the surrounding ground during pile driving. Owing to their slenderness, such piles cannot accommodate much bending stress and an appropriate jack would incorporate a chuck for successively gripping the pile just above ground level and pushing it say 50 cms or more down at each stroke. Although each pile is only capable of accommodating a safe load of 2 tons or a little more, depending upon its diameter, this is all that is necessary if the piles are spaced at no more than 1 m intervals, to take the load of a house or factory building. The close spacing of the piles avoids any long spans between the piles so that the tops of the piles can be united with a thin "flat" concrete slab, such as a slab 150 mm deep and containing a sheet of welded mesh reinforcement. The piles may first be driven down and the thin slab uniting their upper ends subsequently cast. Preferably however the slab is first cast with a number of upright sleeve inserts extending through the slab at intervals where the piles are to be put down. The piles are subsequently driven down through the sleeve, using the sleeves for guidance, and their upper ends grouted into the slab. This has the additional advantage that the weight of the slab can provide the jacking reaction for each pile in turn if the jacking unit is anchored to the slab.

An analogous technique is useful for stabilising an existing concrete raft slab foundation for a building, when the thickness of the raft slab is such that underpinning the edge of the raft slab would be insufficient to prevent the centre of the raft slab buckling downwards. In such cases holes may be bored down through the slab at intervals, a slender pile driven down each hole until the necessary reaction is obtained, and the tops of the piles then grouted into the raft slab.

Conventional piling frequently involves a raising of the ground level as a result of the earth displaced by the piles. In the present method using a comparatively large number of thin piles this problem can be reduced by first putting down piles at the edge of the slab to provide a ground anchor effect on the slab. The remaining piles are then put down but as the slab is anchored it cannot be raised and the only result is that the earth under the slab is compressed.

The advantages of the new method are apparent. Thus there is a minimum amount of digging and a minimum quantity of concrete to be handled irrespective of the reliability of the ground. The hole to receive each pile does not have to be prebored along the full length of the pile although a starter hole may be desirable if the earth's crust is particularly hard. However, the perfection of the bore is unimportant since the foot of the pile will force its own way down into the load bearing earth. Compared with a conventional large piling technique the provision of a large number of slender piles at more closely spaced intervals is simpler and cheaper, both as far as the equipment which is required to handle and insert the piles is concerned, and in the cost of the piles themselves. The improvement in the cost of the piles per se results from the fact that the load bearing ability of a pile depends mainly on skin friction with the ground which in turn is proportional to the diameter of the pile, whereas the cost of the material for making the pile depends upon the volume of the pile which is proportional to the square of the diameter. A reduction in the diameter therefore results in a greater than pro rata reduction of the mass and cost of the pile material to provide an equivalent load bearing effect.

The construction of each pile may take a variety of forms. For example each pile may be made of resin impregnated concrete, or of concrete reinforced with fibres of carbon, polymer, asbestos, glass or metal, or with a reinforcement rod or prestressed or unstressed wires extending along its length. The concrete pile may then be encased in a metal sleeve, such as of galvanised iron, to assist in the pile being driven smoothly through the ground. If the metal sleeve subsequently rusts away this will not matter as it is not responsible for the strength of the pile and in any case the rusting of the metal will involve an increase in volume which will act to hold the pile even more firmly in the ground. Alternatively each pile may be made of metal or other material in the form of solid rod or tube. If the compressive strength of the pile is dependent on metal, the metal selected must be non-corrosive and a rust-resistant steel is appropriate. The degree of rust resistance will depend on an analysis of the salts present in the ground. For certain applications the pile may be constructed from a lower section or sections of reinforced concrete and an upper section or sections of perforated metal.

If the foundation is built over the root system of a recently felled mature tree, there may be a bed of clay which has previously been dried out by the root system of the tree but which may swell upon its moisture content increasing into equilibrium with the surrounding ground. Even if the piles extend through the bed of swelling clay into the stable earth beneath the bed, the swelling of the clay may exert an upthrust on the thin concrete slab sufficient to overcome the ground anchor effect of the piles, causing distortion of the building analogous to that which might be produced by subsidence. If such a condition is thought likely to prevail, the problem can be overcome by providing beneath the cast concrete slab a layer of resilient or crushable material, such as foam polystyrene, which will give and absorb any upward movement of the earth below. The load is thus effectively carried through the concrete slab and the piles down to stable earth and is protected by the resilient or crushable material from any upward movement beneath the concrete.

Although the foundation slab is maintained stable by the large number of piles in both horizontal and vertical directions, horizontal movement of the ground will transmit lateral pressures to the sides of the individual piles with a consequent danger of the slender piles snapping adjacent to the slab. This danger may be overcome by surrounding each needle pile below the slab and within the bed of unstable ground with a material which will absorb lateral thrust and prevent it from being transmitted directly to the pile. Such material may be Bentonite slurry, sand, pea shingle, or other fluent material; or a crushable resilient collar of, for example, carboard or cellular plastics material. In order to prevent such a collar from being stripped from the pile during pile driving, it may be necessary to prebore the ground to a depth sufficient to accommodate the material which absorbs lateral pressures. The prebored hold will not of course extend down into the stable earth into which the foot of the pile will be driven to take the load bearing reaction. Alternatively the top of the pile may simply be protected by a void, in which case the prebored hole will remain unfilled.

The material surrounding the pile, immediately below the slab may be porous and arranged to enable water to percolate into the surrounding ground. For this purpose the upper portion of the pile may be constructed of a perforated tubular metallic section, for example stainless steel, and/or the collar of crushable material surrounding the pile beneath the slab may be porous and may incorporate, in appropriate conditions, an anti-freeze agent. When used in, for example, a bed of dried-out clay, the moisture percolating into the clay beneath the slab will then soften up the clay and provide a lubrication effect enabling the clay or the crushable material, if it is fluent when wet, to "slip around" the piles in the event of relative horizontal movement. Such "wetting up" may be desirable when a mature tree has been felled and the clay has been previously dried out by its root system.

One example of the construction of an open site foundation in accordance with the invention is illustrated in the accompanying drawings both of which are vertical sections through the foundation.

Figure 1:
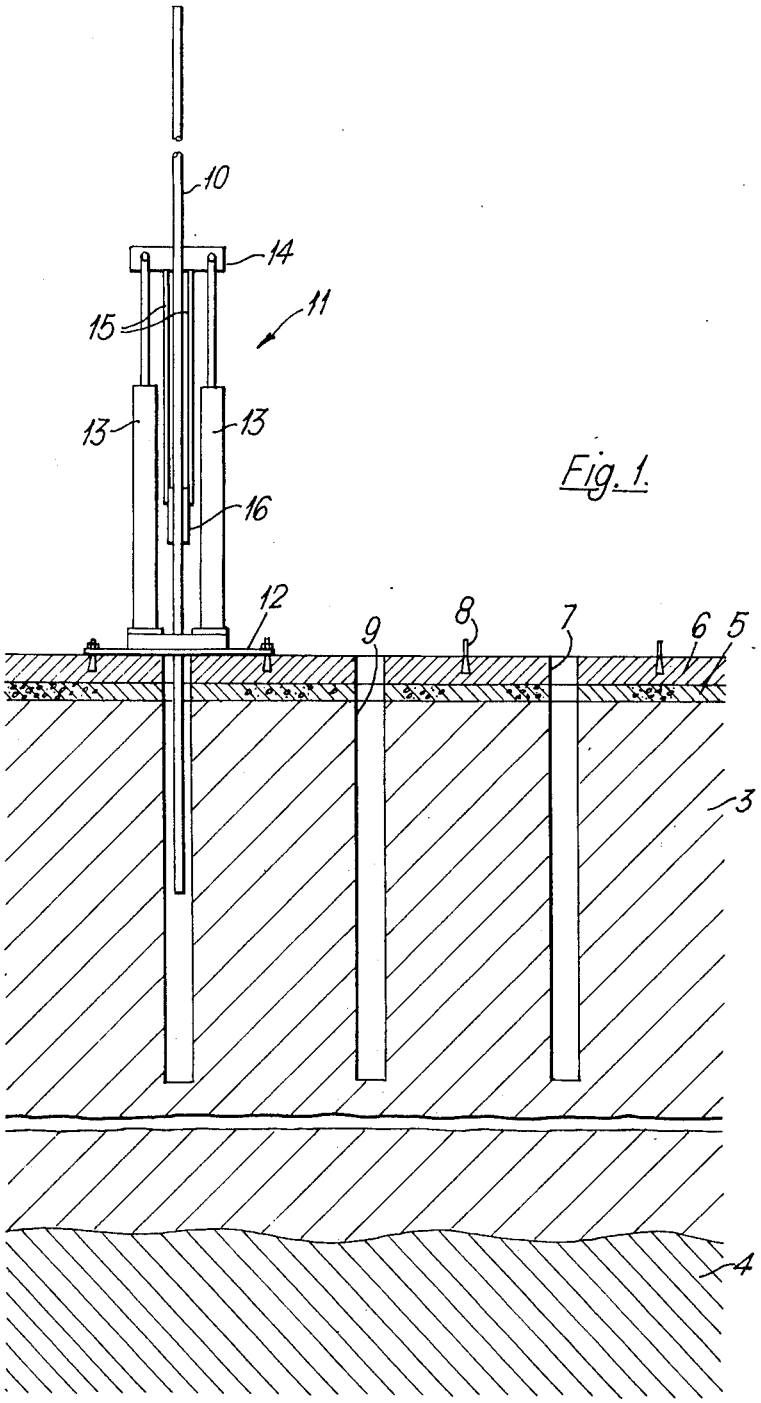
FIG. 1 shows the foundation under construction.

The foundation is to be constructed on unstable ground 3 above a layer of stable ground 4.

Firstly a layer of crushable material 5 is laid on the ground and then a thin slab of concrete 6 is cast with tubular sleeves 7 extending through the casting and through the crushable layer. Anchor bolts 8 are fixed into the slab.

Starter holes 9 are then bored through the slab to a depth of about 2 meters. A pile 10 is then driven down through each hole in turn using a jacking unit 11. The unit 11 has a base plate 12 which is anchored to corresponding bolts 8 and has a pair of double acting hydraulic cylinders 13 the rods of which are pivoted to a cross head 14 connected via arms 15 to a one-way chuck 16.

Figure 2:
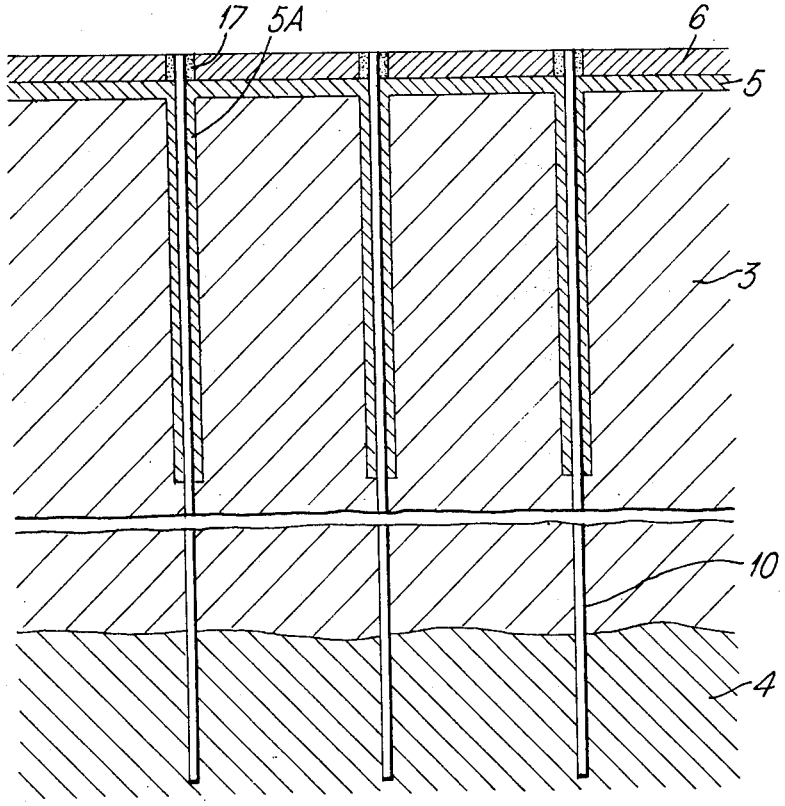
FIG. 2 shows the completed foundation.

As shown in FIG. 1 a reinforced concrete pile 10 of standard length, say 6 meters, is introduced into the unit 11 and advanced down through the hole 9 and into the earth beneath. As the rams 13 are extended the chuck 16 rides up the pile 10 and when the rams are retracted downwards the chuck 16 automatically grips the pile and draws it downwards with a working stroke of up to 1 meter or more Each pile is advanced into the ground until the desired upward reaction is obtained. As indicated in FIG. 2, it can be expected that this will occur when the foot of the pile has entered the load bearing ground 4 to a depth of say 4 meters. The unit 11 is then resited on the slab 6 and the next pile driven in and so on.

After the piles have been driven in, the projecting upper ends of the standard length piles will be cut off flush with the top of the slab 6, the annular space between the top of each pile and the wall of the prebored hole 9 will be filled with crushable material 5A, and the top of each pile will be united with the slab 6 by means of grout 17.

The number and spacing of the piles 10 will depend upon the load to be borne and the drawing shows only part of a slab. However, in a foundation for a typical two storey house, the piles may be put down on a square lattice with 1 m centres, or the piles may be concentrated in positions corresponding to the concentration of the anticipated loading of the building.

Piles may first be put down slowly to anchor the slab so that subsequent piles may be put down more quickly. In order to test the anchoring effect of the first piles, the one way chuck of the jacking unit may be reversible so that the unit can be used for applying an upward pull to a driven pile.

I claim:

1. A method of constructing an open site foundation in clay, comprising the steps of:

providing a plurality of slender piles each having a width in the range of 25 to 100 mm.;

pre-boring a starter hole for each pile of a size larger than the pile;

inserting a pile through each hole and into the clay until a predetermined reaction is obtained;

filling the holes with a fluent material which gives under movement of the clay to prevent lateral pressures on the piles; and thereafter uniting the tops of the piles with a thin concrete slab.

2. A method according to claim 1, including the step of providing a layer of said fluent material on the underside of said concrete slab.

3. A method of constructing an open site foundation in clay, comprising the steps of:

forming a thin concrete slab with a plurality of closely spaced tubular holes extending downwardly therethrough;

providing a plurality of slender piles each having a width in the range of 25 to 100 mm.;

pre-boring a starter hole for each pile of a size larger than the pile;

positioning a jacking unit adjacent one of the tubular holes and anchoring the unit to the concrete slab inserting a pile through said one tubular hole;

jacking the pile into the ground until a pre-determined reaction is reached;

repositioning the jacking unit and jacking succesive closely spaced piles until a desired number of piles have been jacked; and filling the tubular holes in the concrete slab with a grout to unite the tops of the piles with the slab, while leaving the upper portions of the piles, beneath the slab, in an unsupported condition.

4. A method according to claim 3, in which said pile width is between 25 and 65 mm.

5. A method according to claim 3, in which each of said piles is made of reinforced concrete.

6. A method according to claim 5, wherein said reinforcement is selected from the group of carbon, polymer, asbestos, glass, and metal fibers.

7. A method according to claim 3, in which said piles are of standard length and any excess length is cut off after each pile has been jacked into the ground.

8. A method according to claim 3, including the steps of: filling the starter holes with a fluent material which gives under movement of the ground to prevent lateral pressures on the piles; and providing a layer of said fluent material on the underside of said concrete slab.

9. A method of constructing an open site foundation in clay, comprising the steps of:

providing a plurality of slender piles each made of concrete and each having a width in the range of 25 to 65 mm.;

pre-boring a plurality of closely spaced starter holes, one for each pile, of a size larger than the pile;

inserting a pile through each hole and into the clay until a predetermined reaction is obtained; and uniting the tops of the piles with a thin concrete slab while leaving the pre-bored holes void, and leaving the upper portion of the concrete piles below the slab laterally unsupported.

10. A method of constructing an open site foundation in clay, comprising the steps of:

providing a plurality of slender piles each having a width in the range of 25 to 100 mm.;

pre-boring a starter hole for each pile of a size larger than the pile;

inserting a pile through each hole and into the clay until a predetermined reaction is obtained;

filling the holes with a crushable material which gives under movement of the soil to prevent lateral pressures on the piles; and thereafter uniting the tops of the piles with a thin concrete slab.

11. A method according to claim 10, including the step of providing a layer of said crushable material on the underside of said concrete slab.

12. A method according to claim 10, in which said pile width is between 25 and 65 mm.

* * * * *